United States Patent [19]

McClaflin et al.

[11] 4,287,902

[45] Sep. 8, 1981

[54] METHOD OF TRANSPORTING VISCOUS HYDROCARBONS

[75] Inventors: Gifford G. McClaflin; Charles R. Clark, both of Ponca City, Okla.

[73] Assignee: Conoco, Inc., Ponca City, Okla.

[21] Appl. No.: 91,014

[22] Filed: Nov. 5, 1979

[51] Int. Cl.[3] ..... F17D 1/17

[52] U.S. Cl. ..... 137/13; 252/8.55 R; 252/312

[58] Field of Search ..... 252/8.55 R, 8.55 D, 252/8.3, 312; 166/274; 137/13

[56] References Cited

U.S. PATENT DOCUMENTS

| | | | |
|---|---|---|---|
| 2,447,475 | 8/1948 | Kaberg et al. | 252/312 X |
| 3,266,570 | 8/1966 | Gogarty | 166/273 |
| 3,491,835 | 1/1970 | Gagle | 137/13 X |
| 3,506,070 | 4/1970 | Jones | 166/273 |
| 3,926,203 | 12/1975 | Marsden et al. | 137/13 |
| 3,943,954 | 3/1976 | Flournoy et al. | 137/13 |
| 3,950,034 | 4/1976 | Dreher et al. | 137/13 X |
| 3,994,342 | 11/1976 | Healy et al. | 166/275 X |
| 4,108,193 | 8/1978 | Flournoy et al. | 252/8.55 X |
| 4,118,361 | 10/1978 | Lundberg | 137/13 X |

OTHER PUBLICATIONS

Gogarty et al., Article in *Journal of Petroleum Technology,* Dec. 1968, pp. 1407 and 1410–1413.

*Primary Examiner*—Herbert B. Guynn
*Attorney, Agent, or Firm*—Bayless E. Rutherford, Jr.

[57] ABSTRACT

An improvement in the method of transporting viscous hydrocarbons through pipes is disclosed. Briefly, the method comprises adding water containing an effective amount of a combination of an alkaryl sulfonate having a molecular weight of 415 to 470 and a $C_1$–$C_4$ alcohol.

10 Claims, No Drawings

METHOD OF TRANSPORTING VISCOUS HYDROCARBONS

BACKGROUND OF THE INVENTION

1. Field of the Invention

The invention is in the general field of improved methods of pumping viscous hydrocarbons through a pipe, such as a well-bore or a pipeline.

2. General Background

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

The use of oil-in-water emulsions, which use surfactants to form the emulsion, is known in the art.

U.S. Pat. No. 3,943,954 teaches lowering the viscosity of viscous hydrocarbons by adding an aqueous solution containing an anionic surfactant together with a quanidine salt and optionally with an alkalinity agent and/or a nonionic surfactant. The patent teaches that the guanidine salt is required.

Commonly assigned copending application Ser. No. 13,358, filed Feb. 21, 1979, discloses a method of transporting a viscous hydrocarbon through pipes wherein the method uses water containing an effective amount of an alkaryl sulfonate having a molecular weight below about 410. The application contains data which shows that high molecular weight sulfonates are not effective in the method.

We have found that using a $C_1$–$C_4$ alcohol with an alkaryl sulfonate having a molecular weight of about 415 to about 470 provides a composition, which when used in water and added to a viscous hydrocarbon, provides a reduction in viscosity.

BRIEF SUMMARY OF THE INVENTION

Briefly stated, the present invention is directed to an improvement in the method of pumping a viscous hydrocarbon through a pipe wherein the improvement comprises adding from about 20 to about 80 volume percent water containing an effective amount of a combination of an alkaryl sulfonate having a molecular weight of about 415 to about 470 and a $C_1$–$C_4$ alcohol.

DETAILED DESCRIPTION

Insofar as is known our method is suitable for use with any viscous crude oil. It is well known that crude oils often contain a minor amount of water.

The amount of water which is added to the hydrocarbon is suitably in the range of about 20 to about 80 volume percent based on the hydrocarbon. A preferred amount of water is in the range of about 30 to 60 volume percent. The water can be pure or can have a relatively high amount of dissolved solids. Any water normally found in the proximity of a producing oil-well is suitable.

Suitable alkaryl sulfonates for use in my invention have a molecular weight of about 415 to about 480 and are represented by the formula $$R—Ar—SO_3M$$

wherein Ar is an aromatic moiety which is phenyl, tolyl, xylyl or ethylphenyl, R is a linear or branched-chain alkyl group containing 17 to 22 carbon atoms, and M is sodium, potassium or ammonium, but preferably is sodium.

The preferred alkaryl sulfonates are sodium alkylbenzene sulfonates, wherein the alkyl group contains 17 to 22, more suitably 17 to 21, and preferably 18 to 20, carbon atoms.

The alkaryl sulfonates can be natural or synthetic. Usually, they are mixtures containing alkyl groups in the carbon range specified.

Suitable alcohols are those having at least some solubility in water. From a practical viewpoint the $C_4$ isomers are the highest carbon number suitable. Accordingly, suitable alcohols are $C_1$–$C_4$ aliphatic alcohols. The preferred alcohols are methanol, ethanol and isopropanol.

A suitable amount of alkaryl sulfonate is in the range of about 500 to about 10,000 parts per million based on the hydrocarbon. On the same basis the preferred amount of alkaryl sulfonate is in the range of about 1,000 to about 5,000 parts per million.

A suitable amount of alcohol is in the range of 0.1:1 to 10:1, expressed as parts by weight based on the alkaryl sulfonate. On the same basis the preferred amount of alcohol is in the range of 0.5:1 to 5:1.

In order to illustrate the nature of the present invention still more clearly the following examples will be given. It is to be understood, however, that the invention is not to be limited to the specific conditions or details set forth in these examples except insofar as such limitations are specified in the appended claims.

The following materials were used in the tests described herein:

Crude Oil—Goodwin lease crude from Cat Canyon oil field, Santa Maria, Calif.

Water—Goodwin synthetic (Water prepared in laboratory to simulate water produced at the well. It contained 5000 ppm total solids.)

Viscosities were determined using a Brookfield viscometer, Model LVT with No. 3 spindle. The procedure is described below.

The following materials were used in the tests:

Methyl alcohol—reagent grade.

Surfactant "A"—an alkylbenzene sulfonate having a molecular weight in the range of 415–430.

Surfactant "B"—an alkylbenzene sulfonate having a molecular weight in the range of 440–470.

Surfactant "C"—an alkylbenzene sulfonate having a molecular weight in the range of 490–510.

TEST PROCEDURE

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60 and then back down 30, 12, and 6 RPM. Viscosity was calculated by using a multiplication factor of 200, 100, 40 and 20 for the respective speeds times the dial reading on the viscometer.

It may be well to mention that the final result at 6 RPM is an indication of the stability of the solution being tested.

The test was repeated using 300 ml crude oil plus 300 ml of the Goodwin synthetic water containing varying amounts of the described surfactants and combinations of the described surfactants with methyl alcohol.

An additional procedure was used on the crude oil-water-surfactant composition and the crude oil-water-surfactant-alcohol composition. This procedure consisted of stirring the emulsions a second time, allowing them to set for two minutes upon completion of stirring, then making the viscosity determination as previously. This procedure is a more severe test of long term stability for emulsions.

The difference in viscosity values on the crude alone in the examples is due to the varying amount of water naturally present in the crude. For this reason the viscosity value of the crude alone was obtained in each example. The crude corresponded to that used in combination with the aqueous surfactant.

EXAMPLE 1

This example is both comparative and illustrative. It shows the beneficial effect of adding methyl alcohol to Surfactant "A". Viscosity values were obtained on the following:

(a) 300 ml crude oil alone, (b) 300 ml crude oil plus 300 ml water containing 1.21 g (62 percent active) Surfactant "A" (2500 ppm), and (c) 300 ml crude oil plus 300 ml water containing 1.21 g (62 percent active) Surfactant "A" (2500 ppm) and 2.0 ml methyl alcohol (~5300 ppm).

The results for runs (a) and (b) are shown in Table I while the results for run (c) are shown in Table II.

TABLE I

| | Crude Oil Alone (300 ml) Viscosity, cp | Crude Oil Plus 300 ml Water Containing 1.21 g (62% Active) Surfactant "A" (2500 ppm) Viscosity, cp | |
|---|---|---|---|
| RPM | No. 1 | No. 1 | No. 2 |
| 6 | 11,200 | 800 | 12,400 |
| 12 | 9,950 | 650 | O.S. |
| 30 | O.S. | 320 | O.S. |
| 60 | O.S. | 204 | O.S. |
| 30 | O.S. | 300 | O.S. |
| 12 | 9,500 | 580 | 4,100 |
| 6 | 9,500 | 1,600 | 5,200 |

O.S. = Offscale Test Temperature 87° C.
O.S. = Offscale Test Temperature 74° C., 66° C.
Composition foamed badly

TABLE II

| Crude Oil Plus 300 ml Water Containing 1.21 g (62% Active) Surfactant "A" (2500 ppm) And 2.0 ml Methyl Alcohol | | |
|---|---|---|
| | Viscosity, cp | |
| RPM | No. 1 | No. 2 |
| 6 | 140 | 200 |
| 12 | 180 | 100 |
| 30 | 28 | 56 |
| 60 | 36 | 52 |
| 30 | 28 | 32 |
| 12 | 70 | 80 |

TABLE II-continued

| Crude Oil Plus 300 ml Water Containing 1.21 g (62% Active) Surfactant "A" (2500 ppm) And 2.0 ml Methyl Alcohol | | |
|---|---|---|
| | Viscosity, cp | |
| RPM | No. 1 | No. 2 |
| 6 | 80 | 140 |

Test Temperature 78° C., 74° C.
Composition had very little foam

EXAMPLE 2

This example is both comparative and illustrative. It shows the beneficial effect of adding methyl alcohol to Surfactant "B". Viscosity values were obtained on the following:

(a) 300 ml crude oil alone, (b) 300 ml crude oil plus 300 ml water containing 1.21 g (62 percent active) Surfactant "B" (2500 ppm), and (c) 300 ml crude oil plus 300 ml water containing 1.21 g (62 percent active) Surfactant "B" (2500 ppm) and 2.0 ml methyl alcohol (~5300 ppm).

The results for runs (a) and (b) are shown in Table III while the results for run (c) are shown in Table IV.

TABLE III

| | Crude Oil Alone (300 ml) | Crude Oil Plus 300 ml Water Containing 1.21 g (62% Active) Surfactant "B" (2500 ppm) Viscosity, cp | |
|---|---|---|---|
| RPM | Viscosity, cp | No. 1 | No. 2 |
| 6 | 11,880 | 960 | 2,100 |
| 12 | O.S. | 1,200 | 1,650 |
| 30 | O.S. | 800 | 1,320 |
| 60 | O.S. | 100 | 130 |
| 30 | O.S. | 112 | 172 |
| 12 | O.S. | 160 | 260 |
| 6 | 10,400 | 340 | 360 |

O.S. = Offscale Test Temperature 91° C.
Test Temperature 78° C., 70° C.
Composition had moderate foam

TABLE IV

| Crude Oil Plus 300 ml Water Containing 1.21 g (62% Active) Surfactant "B" (2500 ppm) And 2.0 ml Methyl Alcohol | | |
|---|---|---|
| | Viscosity, cp | |
| RPM | No. 1 | No. 2 |
| 6 | 40 | 160 |
| 12 | 50 | 80 |
| 30 | 60 | 52 |
| 60 | 52 | 36 |
| 30 | 56 | 60 |
| 12 | 180 | 70 |
| 6 | 360 | 340 |

Test Temperature 77° C., 73° C.
Composition had very little foam

EXAMPLE 3

This example is comparative in that it shows that addition of methyl alcohol has no beneficial effect on an alkylbenzene sulfonate having a molecular weight of 490–510 (Surfactant "C"). Viscosity values were obtained on the following:

(a) 300 ml crude oil alone, (b) 300 ml crude oil plus 300 ml water containing 1.21 g (62 percent active) Surfactant "C" (2500 ppm), and (c) 300 ml crude oil plus 300 ml water containing 1.21 g (62 percent active) Surfactant "C" (2500 ppm) plus 2.0 ml methyl alcohol (~5300 ppm).

The results for runs (a) and (b) are shown in Table V while the results for run (c) are shown in Table VI.

TABLE V

| RPM | Crude Oil Alone (300 ml) Viscosity, cp | Crude Oil Plus 300 ml Water Containing 1.21 g (62% Active) Surfactant "C" (2500 ppm) Viscosity, cp No. 1 | No. 2 |
|---|---|---|---|
| 6 | 12,260 | O.S. | O.S. |
| 12 | O.S. | O.S. | O.S. |
| 30 | O.S. | O.S. | O.S. |
| 60 | O.S. | O.S. | O.S. |
| 30 | O.S. | O.S. | O.S. |
| 12 | O.S. | O.S. | O.S. |
| 6 | 11,600 | O.S. | O.S. |

O.S. = Offscale Test Temperature 90° C.
O.S. = Offscale Test Temperature 79° C., - Composition failed

TABLE VI

| RPM | Crude Oil Plus 300 ml Water Containing 1.21 g (62% Active) Surfactant "C" (2500 ppm) And 2.0 ml Methyl Alcohol Viscosity, cp No. 1 | No. 2 |
|---|---|---|
| 6 | O.S. | O.S. |
| 12 | O.S. | O.S. |
| 30 | O.S. | O.S. |
| 60 | O.S. | O.S. |
| 30 | O.S. | O.S. |
| 12 | O.S. | O.S. |
| 6 | O.S. | O.S. |

O.S. = Offscale Test Temperature 78° C., - Composition failed

The test results from the examples show clearly that addition of a small amount of methyl alcohol to Surfactants "A" and "B" provided a significant reduction in viscosity. The test results show that addition of methyl alcohol to Surfactant "C" (molecular weight 490–510) did not provide any improvement.

Examples 1–3 are repeated substituting ethyl alcohol and isopropyl alcohol for methyl alcohol. Similar results are obtained.

Thus, having described the invention in detail, it will be understood by those skilled in the art that certain variations and modifications may be made without departing from the spirit and scope of the invention as defined herein and in the appended claims.

We claim:

1. In the method of transporting viscous crude oil through a pipe the improvement which comprises forming an oil-in-water emulsion by adding to said crude oil about 20 to about 80 volume percent of an aqueous solution containing an effective amount of a combination of (a) about 500 to about 10,000 parts per million, based on said crude oil, of an alkaryl sulfonate having a molecular weight of about 415 to about 470 and being represented by the formula $$R—Ar—SO_3M$$

wherein Ar is an aromatic moiety which is phenyl, tolyl, xylyl or ethylphenyl, R is a linear or branched-chain alkyl group containing 17 to 22 carbon atoms, and M is sodium, potassium or ammonium, and (b) methanol, wherein the amount of methanol is in the range of 0.1:1 to 10:1 parts by weight based on the alkaryl sulfonate.

2. The method of claim 1 wherein the alkaryl sulfonate is a sodium alkylbenzene sulfonate wherein the alkyl group contains 17 to 22 carbon atoms.

3. The method of claim 2 wherein the amount of alkylbenzene sulfonate is about 1,000 to about 5,000 parts per million.

4. The method of claim 3 wherein the amount of methanol is in the range of about 0.5:1 to 5:1.

5. The method of claim 1 wherein the amount of aqueous solution added to said crude oil is about 30 to about 60 volume percent based on said crude oil.

6. The method of claim 5 wherein the alkaryl sulfonate is a sodium alkylbenzene sulfonate wherein the alkyl group contains 17 to 22 carbon atoms.

7. The method of claim 6 wherein the amount of alkylbenzene sulfonate is about 1,000 to about 5,000 parts per million.

8. The method of claim 7 wherein the amount of methanol is in the range of about 0.5:1 to 5:1.

9. The method of claim 1 wherein there is used about 50 percent of an aqueous solution containing about 2500 parts per million of a sodium alkylbenzene sulfonate, having a molecular weight in the range of about 415 to about 430, and about 5300 parts per million of methanol.

10. The method of claim 1 wherein there is used about 50 percent of an aqueous solution containing about 2500 parts per million of a sodium alkylbenzene sulfonate, having a molecular weight in the range of about 440 to about 470, and about 5300 parts per million of methanol.

* * * * *